US005552068A

United States Patent [19]

Griffith

[11] Patent Number: 5,552,068

[45] Date of Patent: Sep. 3, 1996

[54] LUBRICANT COMPOSITION CONTAINING AMINE PHOSPHATE

[75] Inventor: Martin G. Griffith, Westfield, N.J.

[73] Assignee: Exxon Research and Engineering Company, Florham Park, N.J.

[21] Appl. No.: 284,772

[22] Filed: Aug. 2, 1994

Related U.S. Application Data

[63] Continuation-in-part of Ser. No. 113,153, Aug. 27, 1993.

[51] Int. Cl.[6] ..... C10M 137/08

[52] U.S. Cl. ..... 508/436; 508/437

[58] Field of Search ..... 252/32.5, 49.9

[56] References Cited

U.S. PATENT DOCUMENTS

| | | | |
|---|---|---|---|
| 4,645,610 | 2/1987 | Born et al. | 252/45 |
| 4,701,273 | 2/1987 | Brady et al. | 252/32.5 |
| 4,704,216 | 11/1987 | Hata et al. | 252/32.7 |
| 5,094,763 | 3/1992 | Tochigi et al. | 252/46.6 |

FOREIGN PATENT DOCUMENTS

| | | |
|---|---|---|
| 8707637 | 12/1987 | WIPO . |
| WO87/07637 | 12/1987 | WIPO . |
| WO91/09922 | 11/1991 | WIPO . |

*Primary Examiner*—Prince Willis, Jr.
*Assistant Examiner*—Cephia D. Toomer
*Attorney, Agent, or Firm*—James H. Takemoto; Joseph J. Allocca

[57] ABSTRACT

A lubricant oil composition having balanced antiwear/extreme pressure and stability properties while providing friction reduction which comprises:

(1) a major amount of a lubricating oil basestock; and (2) a minor amount of an amine phosphate salt of the formula:

(I)

where $R_1$ is $C_9$ to $C_{22}$, $R_2$ and $R_3$ are each independently $C_1$ to $C_4$ hydrocarbyl, $R_4$ is $c_{10}$ to $c_{20}$ hydrocarbyl, and $R_5$ is hydrogen to $c_{10}$ to $c_{20}$ hydrocarbyl; wherein the amine phosphate salt is soluble in the lubricant oil basestock at 25C, is a liquid at 25C, and the ratio of gram-atomic-equivalents of amine to phosphate in said salt is from about 1.0 to 1.2.

8 Claims, 1 Drawing Sheet

LUBRICANT COMPOSITION CONTAINING AMINE PHOSPHATE

This application is a continuation-In-part of U.S. Ser. No. 113,153 filed Aug. 27, 1993.

BACKGROUND OF THE INVENTION

1. Field of the Invention

This invention relates to a lubricant composition containing amine phosphate salts as a load carrying additive to provide lubricant compositions having balanced antiwear/extreme pressure and stability properties.

2. Description of the Related Art

Industrial oils such as gear oils which function under high contact pressures between moving parts typically contain a variety of additives to improve properties of the oil. Typical additives include viscosity improvers, extreme pressure agents, oxidation and corrosion inhibitors, pour point depressants, antiwear agents and foam inhibitors. PCT published application WO 87/07637 relates to a lubricating oil composition having improved high temperature stability which contains an amine phosphorus salt and the reaction product of a hydrocarbon-substituted succinic acid producing compound and an amine.

A problem encountered with commercial industrial oils which contain load-carrying additives is that corrosion and stability problems may develop over time which result in deposit formation, plugging of passages and filters, generation of acids, corrosion of metals, especially copper, and interference with lubrication. It would be desirable to have an industrial oil with excellent load carrying properties which is stable in prolonged use, especially at elevated temperatures and in the presence of water contamination.

SUMMARY OF THE INVENTION

This invention relates to a lubricant oil composition having balanced anti-wear/extreme pressure and stability properties while providing friction reduction which comprises:

(1) a major amount of a lubricating oil basestock; and (2) a minor amount of an amine phosphate salt of the formula

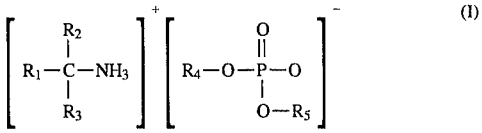

(I)

where $R_1$ is $C_9$ to $C_{22}$ hydrocarbyl, $R_2$ and $R_3$ are each independently $C_1$ to $C_4$ hydrocarbyl, $R_4$ is $C_{10}$ to $C_{20}$ hydrocarbyl, and $R_5$ is hydrogen or $C_{10}$ to $C_{20}$ hydrocarbyl; wherein the amine phosphate salt is soluble in the lubricant oil basestock at 25° C., is a liquid at 25° C., and the ratio of molar equivalents of amine to phosphate in said salt is from about 1.0 to 1.2. The invention also relates to a method for improving the extreme pressure, antiwear and stability properties of industrial oils, hydraulic oils and gear oils while providing friction reduction which comprises mixing a major amount of a lubricating oil base stock and a minor amount of an amine phosphate salt of the formula (I) above.

DETAILED DESCRIPTION OF THE INVENTION

Figure 1:
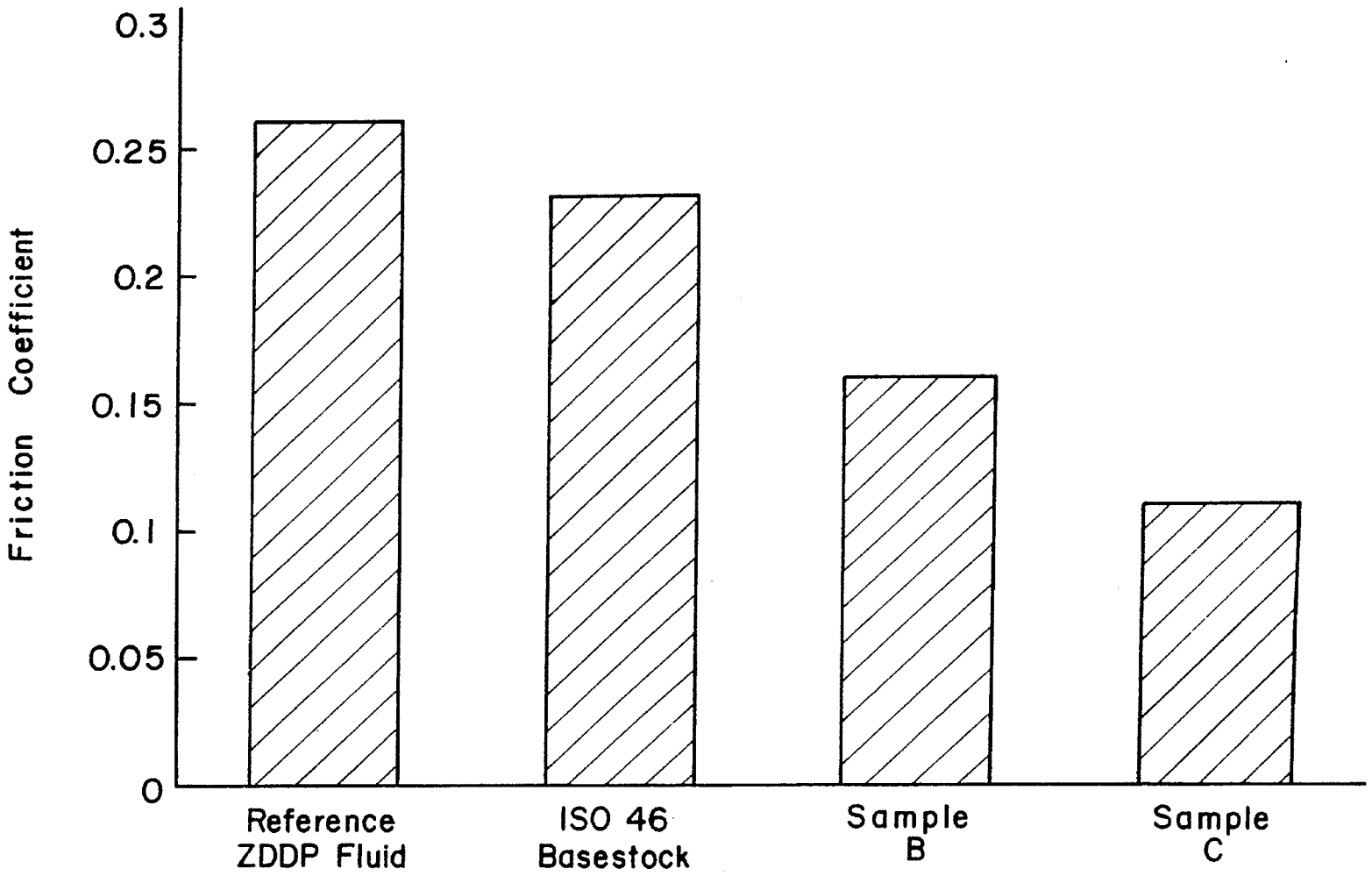
FIG. 1 is a graph of friction coefficients as a function of additive combination.

This invention requires a lubricating oil basestock and an amine phosphate salt of the formula (I). The lubricating oil base-stock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins which may be hydrogenated or non-hydrogenated (e.g., polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g., dodecylbenzenes, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from linear or branched $C_5$ to $C_{12}$ monocarboxylic acids and polyols and polyol ethers such as neopentyl glycol, trimethylolpropane, pentaerythritol, dipentaerythritol, tripentaerythritol, pentaerythritol monoethylether, and the like. This class of synthetic oils is particularly useful as aviation turbine oils.

Silicon-based oils (such as the polyakyl-, polyaryl-, polyalkoxy-, or polyaryloxy-siloxane oils and silicone oils) comprise another useful class of synthetic lubricating oils.

These oils include tetraethyl silicone, tetraisopropyl silicone, tetra-(2-ethylhexyl) silicone, tetra-(4-methyl-2-ethylhexyl) silicone, tetra(p-tert-butylphenyl) silicone, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

In the amine phosphate salts of the formula (I), $R_1$ is preferably $C_9$ to $C_{20}$ hydrocarbyl. The hydrocarbyl groups include aliphatic (linear or branched alkyl or alkenyl) which may be substituted with hydroxy, amino and the like. Preferred hydrocarbyl groups are linear or branched alkyl. $R_2$ and $R_3$ are each independently $C_1$ to $C_4$ alkyl. Most preferably, $R_1$ is a branched hydrocarbyl group, and $R_2$ and $R_3$ are each independently methyl. $R_4$ is preferably $C_{12}$ to $C_{16}$ straight chain alkyl and $R_5$ is preferably $C_{12}$ to $C_{16}$ straight chain alkyl or hydrogen, especially hydrogen.

The amine phosphate salts of one formula (I) are prepared by controlled neutralization of acid phosphate with amine. Commercially available acid phosphates are typically mixtures of

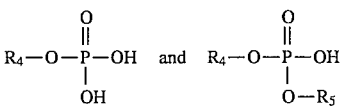

and are prepared from the reaction of $P_2O_5$ with an alcohol. In preparing the amine phosphate salts according to the invention by neutralizing the acid phosphate with amine, it is important to control the amount of neutralization. This is accomplished by limiting the amount of amine added to acid phosphate to an amine:acid phosphate molar ratio of about 1.2 to 1, preferably 1.1 to 1. Insufficient neutralization results in undesirable corrosion properties for the amine phosphate whereas excessive neutralization may adversely affect its load carrying properties and oxidation stability.

It is also desirable to have an amine phosphate salt which is liquid at room temperature and which is soluble in the lubricant oil basestock. Liquids are generally more soluble and solubility is an important consideration in avoiding deposit formation which interferes with lubrication of the system being lubricated. Thus the present invention concerns amine phosphate salts wherein the hydrocarbyl moiety attached to the amino group is preferably branched. Such branched amines provide amine phosphate salts which possess the desired properties of being liquid and soluble.

The hydrocarbyl groups(s) attached to the phosphate moiety also influence the load carrying properties of the amine phosphate salt. In order to provide an amine phosphate which is hydrolytically stable and has acceptable antiwear properties, it is preferred that the phosphate be about 50% monohydrocarbyl on a molar basis.

The amount of amine phosphate salt of the formula (I) added to the lubricant oil basestock need only be the amount effective to impart load carrying properties to the lubricant oil. In general, this amount is from about 0.01 to about 10 wt%, based on lubricating oil, preferably about 0.1 to about 2 wt%.

If desired, other additives known in the art may be added to the lubricating oil basestock. Such additives include dispersants, other antiwear agents, antioxidants, rust inhibitors, corrosion inhibitors, detergents, pour point depressants, other extreme pressure additives, viscosity index improvers, other friction modifiers, hydrolytic stabilizers and the like. These additives are typically disclosed, for example, in "Lubricant Additives" by C. V. Smalhear and R. Kennedy Smith, 1967, pp. 1–11, and "Lubricants and Related Products" by D. Klamann, Verlag Chemie, 1984.

A lubricating oil containing amine phosphate salt of the formula (I) can be used in essentially any application where wear protection, extreme pressure activity and/or friction reduction is required. Thus, as used herein, "lubricating oil" (or "lubricating oil composition") is meant to include aviation lubricants, automotive lubricating oils, industrial oils, gear oils, transmission oils, and the like.

The amine phosphate salts of this invention are particularly useful in industrial oils, hydraulic oils and gear oils.

This invention may be further understood by reference to the following examples, which include a preferred embodiment of the invention:

EXAMPLE 1

The preparation of an amine phosphate salt from cetyl acid phosphate and Primene JMT™ is described herein. Cetyl acid phosphate is commercially available from Chemron Corp. as a mixture of

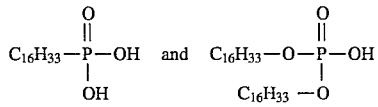

Primene JMT™ is commercially available from Rohm and Haas Company as a mixture of tertiary $C_{18}$ to $C_{22}$ alkyl primary amines. 1.1 moles of Primene JMT™ amine is heated with 1.0 moles of cetyl acid phosphate at 70° C. with stirring for one hour. The reaction product can be used without further purification.

The resulting amine phosphate salt is a clear liquid which has a viscosity of 440 centistokes at 40° C. It is thermally stable to 233° C. as determined by Differential Scanning Caloimetry, is hydrolytically stable and is soluble in petroleum basestocks such as Solvent 150N and Solvent 600N, and saturate basestocks such as polyalphaolefins.

EXAMPLE 2

A number of different amines were reacted with cetyl acid phosphate (CAP) to produce amine phosphate salts. For each preparation, 27.5 g of CAP (7.23% P, containing 64.5 mmole P, 2.0 g) is reacted with sufficient amine to provide 71.0 mmole nitrogen (1.0 g), which is a 10% excess of nitrogen over phosphorus on a gram atomic equivalent basis. The mixtures are heated to 70° C. and stirred for one hour. The resulting amine phosphates were then tested for solubility in a Solvent Neutral petroleum basestock, having a viscosity of 46 cSt at 40° C., at a concentration to provide 200 ppm phosphorus in the blend. The results are shown in Table 1.

TABLE 1

| Amine-Cetyl Acid Phosphate Salt | Grams of Amine | Appearance of CAP/ Amine Combination | Solubility of Amine Phosphate in Solvent Neutral Basestocks |
|---|---|---|---|
| n-decylamine | 11.5 | Solid | Insoluble |
| n-dodecylamine | 13.6 | Solid | Insoluble |
| n-octadecylamine | 19.8 | Solid | Insoluble |
| didecylmethyl-amine (Ethyl DAMA 1010) | 22.8 | Solid | Insoluble |
| $C_{12-14}$t-alkylamine (Primene 81-R) | 13.7 | Liquid | Soluble |
| $C_{18-22}$t-alkylamine (Primene JM-T) | 21.9 | Liquid | Soluble |

Table 1 demonstrates that only the tertiary alkyl primary amines form amine phosphate salts which are both liquid and soluble in basestock. Liquid salts are generally more soluble than their solid counterparts. This enhanced solubility leads to desirable properties such as ease of blending and lack of deposit formation.

EXAMPLE 3

This example compares the effect of the absolute value of amine:phosphate ratio on the properties of the amine phosphate. The absolute value of the ratio of amine:alkyl acid phosphate is important in determining the optimum properties of the resulting amine phosphate. The amine moderates the corrosivity of the acid phosphate by neutralizing the first acidic hydrogen. Addition of amine much in excess of that required for the first neutralization is not necessary and may adversely affect the performance of the amine phosphate. In a titration of a mixed alkyl acid phosphate by a strong base, the first —OH titrates between pH=2–6. The second —OH attached to phosphous titrates between pH=7–11. We have found that it is sufficient and desirable to control the ratio of amine to alkyl acid phosphate so that the ratio of gram-atomic-equivalents of nitrogen to phosphorus is about 1.1. This assures that there is sufficient amine to provide the desired neutralization and minimal excess to adversely affect performance. For the reaction of cetyl acid phosphate (CAP) with $C_{18-22}$ t-alkylamine (TAM), the proportion of amine to acid phosphate which provides the desired ratio is 82 g $C_{18-22}$ t-alkylamine to 100 g CAP.

A series of amine phosphates were prepared using various ratios of TAM to CAP.

TABLE 2

| Amine Phosphate Preparation | Weight of TAM:CAP | Atomic Ratio of Nitrogen Phosphorus | Base/Acid Neutralization Ratio | pH |
|---|---|---|---|---|
| A | 72:100 | 1.0 | 0.62 | 6.3 |
| B | 82:100 | 1.1 | 0.70 | 7.4 |
| C | 91:100 | 1.3 | 0.78 | 7.6 |
| D | 100:100 | 1.4 | 0.86 | 7.8 |

TABLE 2-continued

| Amine Phosphate Preparation | Weight of TAM:CAP | Atomic Ratio of Nitrogen Phosphorus | Base/Acid Neutralization Ratio | pH |
|---|---|---|---|---|
| E | 109:100 | 1.5 | 0.93 | 8.0 |
| F | 117:100 | 1.6 | 1.00 | 8.0 |

A series of hydraulic oil formulations containing the amine phosphate preparations and oxidation inhibitors were tested for oxidation stability by the Rotary Bomb Oxidation test (RBOT, ASTM D2272). Each formulation contains 0.50% 2,6-di-t-butylphenol and 0.20% p,p'-dioctyldiphenylamine antioxidants in addition to amine phosphate at a concentration to give 100 ppm of phosphorus in the blend. The base oil is Solvent 150 Neutral which is a petroleum lubricant basestock having a viscosity of approximately 32 cSt at 40° C.

TABLE 3

| Amine Phosphate Preparation in Petroleum Base Oil | Rotary Bomb Oxidation Life (Minutes) |
|---|---|
| none | 453 |
| 0.24% A | 170 |
| 0.25% B | 157 |
| 0.27% C | 148 |
| 0.28% D | 148 |
| 0.29% E | 128 |
| 0.30% F | 130 |

The above data in Table 3 demonstrate that the addition of amine phosphate reduces the oxidation stability of a petroleum base containing oxidation inhibitors. The base without amine phosphate has a RBOT life of 453 minutes. The addition of 0.24% of amine phosphate A, which has a N:P ratio of 1:1, lowers the life to 170 minutes. Increasing the amine content results in lower stability and lower RBOT lifetimes. With 0.30% amine phosphate F (N:P=1.6:1), RBOT life is reduced to 130 minutes. The optimum amine phosphate B, having N:P=1:1.1, contains the minimum amount of reserve amine to assure neutrality and lowers the RBOT life to only 157 minutes.

It has been discovered that excess amine can interfere with the antiwear performance of the amine phosphate. Blends of the amine phosphate preparations were made in a petroleum base oil having a viscosity of 46 cSt at 40° C. and containing 0.40% of an antioxidant 2,6-di-t-butyl-p-cresol. The amine phosphates were blended at concentrations to give 200 ppm phosphorus and tested in the 4-Ball wear test, ASTM D4172, under the conditions of 70 kg load, 1200 rpm, 90° C., for 1 hour test duration. Example 4 provides further details concerning the 4-Ball wear test.

TABLE 4

| Amine Phosphate Preparation in Petroleum Base Oil | 4-Ball Wear Test Scar Diameter (mm) 70 kg/1200 rpm/90° C./1 hr |
|---|---|
| none | 2.51 |
| 0.50% B | 0.48 |
| 0.55% D | 0.51 |
| 0.60% F | 1.92 |

As shown in table 4, under these severe conditions without amine phosphate, the lubricant provides no antiwear protection to protect the steel surfaces from damage and high wear occurs which results in a wear scar of 2.51 mm in diameter. With 0.50% of amine phosphate B, which has a N:P ratio of 1.1:1, the wear scar diameter is only 0.48. However, with 0.60% of amine phosphate F(N:P=1.6:1), a wear scar of 1.92 mm is obtained indicating a significant loss in protection.

EXAMPLE 4

This example compares the load carrying and stability properties of various amine phosphates. Samples A and B are commercially available amine phosphates. Sample C is the amine phosphate prepared in Example 1.

The Four Ball wear test is described in detail in ASTM method D-4172. In this test, three balls are fixed in a lubricating cup and an upper rotating ball pressed against the lower three balls. The test balls were made of AISI 52100 steel with a hardness of 65 Rockwell C (840 Vickers) and a centerline roughness of 25 nm. The Four Ball wear tests were performed at 90° C., 60 Kg load, and 1200 RPM for a one hour duration, after which the wear scar diameter on the lower balls were measured using an optical microscope.

Friction coefficient is measured in the Four Ball wear test by measurement of the torque transmitted to the lower three-ball assembly. Frictional Force (F) is measured at a distance (L) from the center of rotation. Torque (T) is calculated as T=F×L, and the coefficient of friction is calculated from torque as:

f, coefficient of friction=(2.23 T)/P where P=applied load in kg, F measured frictional force in kg, and L=friction lever arm in cm.

Hydrolytic Stability is measured according to ASTM Method D-2619, Hydrolytic Stability of Hydraulic Fluids (Beverage Bottle Method). In this test a sample of 75 g of test fluid and 25 g of water and a copper test specimen are sealed in a pressure-type beverage bottle. The bottle is rotated for 48 hours in an oven at 93° C. At the end of that time the acidity of the water layer is measured. The degree of formation of acids in the water layer is an indication of susceptibility to reaction with water (hydrolysis). Also measured in this test is the weight change of the copper test specimen which provides an indication of the corrosivity of the fluid to copper under wet conditions.

Thermal stability was measured by Differential Scanning Calorimetry (DSC) which is a technique in which the difference in energy inputs into a substance and a reference material is measured as a function of temperature, while the substance and reference material are subjected to a controlled temperature program. In the method employed temperature is increased at a rate of 5° C. per minute beginning at 90° C. and ending at 350° C. under an atmosphere of Argon at 500 psi pressure. The temperature at which a rapid evolution of heat begins indicating thermal degradation is recorded as the DSC Thermal Stability breakpoint.

The results of the above tests are summarized in Table 5.

TABLE 5

| | Amine Phosphate Composition* | | 4-Ball Wear* | | Hydrolytic* | |
|---|---|---|---|---|---|---|
| | | | Wear | Friction | Stability | DSC Thermal** |
| Sample Number | Acid Phosphate, Alkyl Group | Alkyl Amine Group | Scar (mm) | Coef. (max) | Water Acidity mg KOH | Stability °C. |
| A | $C_8$ | $C_{12}$ prim. | 1.80 | 0.15 | 6.6 | |
| B | $C_6$ | $C_{12}$ sec. | 0.46 | 0.09 | 15.6 | 207 |
| C | n-$C_{16}$ | t-$C_{20}$ prim. | 0.47 | 0.07 | 2.3 | 233 |

*These were tested in a Solvent Neutral petroleum basestock having a viscosity of 46 cSt. at 40° C. The concentration of amine phosphate was that to provide 380 ppm phosphorus in the blend.
**Tested on the neat amine phosphate.

The above results show that Sample C which is an amine phosphate according to the invention possesses superior 4-ball wear, hydrolytic stability and thermal stability properties as compared to the other commercial amine phosphates. The superior wear protection provided by Sample C is seen in the low value for 4-ball wear scar diameter, 0.47 mm and in the low friction coefficient of 0.07. The hydrolytic stability of Sample C is superior to that of the commercial samples as seen by the low value of water acidity, 2.3 mg KOH compared to values of 6.6 and 15.6 for the commercial samples. The thermal stability of Sample C as measured by DSC breakpoint is 233° C. which is significantly higher than that of commercial Sample B, 207° C.

EXAMPLE 5

Amine phosphates according to the invention provide superior friction reduction as demonstrated in this example. The Ball on Cylinder (BOC) friction tests were performed using the experimental procedure described by S. Jahanmir and M. Beltzer in ASLE Transactions, Vol. 29, No. 3, p. 425 (1985) using a force of 39.2 Newtons (4 Kg) applied to a 12.5 mm steel ball in contact with a rotating steel cylinder that has a 43.9 mm diameter. The cylinder rotates inside a cup containing a sufficient quantity of lubricating oil to cover 2 mm of the bottom of the cylinder. The cylinder was rotated at 0.20 rpm. The friction force was continuously monitored by means of a load transducer. In the tests conducted, friction coefficients attained steady state values after 7 to 12 turns of the cylinder. Friction experiments were conducted with an oil temperature of 90° C. The friction coefficients (FC) at the end of 60 minutes are shown in FIG. 1. In FIG. 1, Samples B and C are as defined in Example 4. The ZDDP reference is a zinc dialkyldithiophosphate wherein the alkyl is a primary alkyl of about $C_8$. ISO46 Basestock is a blend of S150N and S600N basestocks having a viscosity of 46 cSt at 40° C. FIG. 1 shows that Sample C which is the amine phosphate according to the invention provides the lowest friction coefficient which in turn indicates superior lubrication performance.

EXAMPLE 6

The improved stability and reduced copper corrosivity of the present amine phosphates is shown in this example. The amine is that described in Example 1. The carbon number of the alkyl group of the acid phosphates ranges from $C_8$ to $C_{16}$. Copper corrosivity was measured by weight change of the copper specimen after 48 hours in the ASTM Method D-2619 Hydrolytic Stability test as described in Example 4. The acidity of the water layer was measured by titration of the water layer with 0.1N KOH aqueous solution to a phenolphthalein end point as described in ASTM Method D-2619. Industry accepted specification limites for a formulated hydraulic oil are 0.20 mg/cm$^2$ copper weight loss, and maximum acidity for the water layer equivalent to 4.0 mg KOH. The results are shown in Table 6.

TABLE 6

| Carbon | Copper Weight Change (mg/cm$^2$) | | Acidity of Water Layer (mg KOH) | |
|---|---|---|---|---|
| Number of Alkyl Acid Phosphate | Without Alkyl Amine | With Alkyl Amine | Without Alkyl Amine | With Alkyl Amine |
| 8 | −4.2 | −0.3 | 7.5 | 5.7 |
| 12 | −1.8 | −0.1 | 7.1 | 1.2 |
| 14 | +0.5 | −0.1 | 6.7 | 1.5 |
| 16 | +0.1 | −0.2 | 2.8 | 2.3 |

As shown in the data in Table 6, the alkyl acid phosphate having the lowest chain length, $C_8$ has the highest copper corrosivity and the lowest resistance to hydrolysis either with or without alkyl amine. Without amine the copper weight loss is 4.2 mg/cm$^2$ which far exceeds the 0.20 limit, and with amine the weight loss is 0.3 mg/cm$^2$ which still exceeds the limit. Also, without amine the acidity of the water layer is 7.5 mg KOH and with amine the acidity is 5.7 mg KOH, both values exceeding the limit of 4.0 mg KOH maximum.

For the alkyl acid phosphates of this invention having alkyl chain lengths of $C_{12}$ to $C_{16}$ the resulting amine phosphates each meet the industry limits for copper weight change and for water acidity. Furthermore, the alkyl acid phosphate having $C_{16}$ alkyl chain length meets the limits even without amine which demonstrates the superior inherent stability of the long straight chain cetyl acid phosphate.

EXAMPLE 7

This example demonstrates the superior stability of a gear oil formulated with the amine phosphate according to this invention compared to a formulation which employs the commercial amine phospate described in Example 4 as "Sample A". The formulation of the gear oil base (without amine phosphate) is shown in Table 7.

TABLE 7

| | Mass % |
|---|---|
| Polyalphaolefin basestock of viscosity 220 cSt at 40° C. | 97.66 |
| Sulfurized hydrocarbon containing 20% sulfur | 2.00 |
| Phenolic antioxidant | 0.25 |
| Tolyltriazole Derived Metal Deactivator | 0.08 |
| Polyacrylate Antifoamant | 0.01 |

To the Gear Oil Base was added amine phosphate sufficient to provide 0.04% of phosphorus in the blend. Each blend was tested in the Cincinnati Milacron Thermal Stability test, Procedure "A" This is a test designed for hydraulic oils and is considered very severe for extreme pressure (EP) gear oils. In this test 200 ml of test fluid are placed in a beaker with a polished copper rod and a polished iron rod. The beaker is placed in an oven for 168 hours at 135° C. At the end of that time the copper and iron rods are cleaned and rated for weight change and for appearance. The oil is filtered and the insolubles (sludge) is measured. The results of tests with the two gear oil formulations are given in Table 8.

TABLE 8

| | OIL 1 Commercial Amine Phosphate "Sample A" in Gear Oil Base | OIL 2 Amine Phosphate of this Invention "Sample C" in Gear Oil Base |
|---|---|---|
| Copper Rod Appearance | Black Corrosion | Light Tarnish |
| Copper Rod Weight Change, mg | −8.7 | +2.3 |
| Iron Rod Appearance | Moderate Tarnish | Light Tarnish |
| Iron Rod Weight Change, mg | +12.1 | +4.4 |
| Sludge Weight, mg/100 ml | 77.3 | 4.8 |

Each of these oils has a Timken EP OK Load of at least 60 pounds according to ASTM Method D-2782, Standard Test Method for Measurement of Extreme-Pressure Properties of Lubricating Fluids (Timken Method), and therefore each qualifies as an EP gear oil. However, the stability of Oil 2 which contains the amine phosphate of this invention is much superior to that of Oil 1 which contains the commercial amine phospate. The degree of corrosion and weight change of the copper and iron test specimens are much less for Oil 2, and the sludge is much less, only 4.8 mg/100 ml compared to 77.3 mg for Oil 1.

What is claimed is:

1. A method for improving the extreme pressure, antiwear and stability properties of industrial, hydraulic and gear oils while providing friction reduction and reduced copper corrosivity which comprises mixing a major portion of a lubricating oil base stock with a minor amount of an amine phosphate salt of the formula

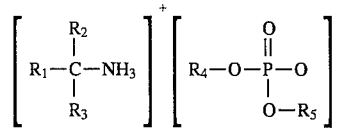

(I)

where $R_1$ is $C_9$ to $C_{22}$ hydrocarbyl, $R_2$ and $R_3$ are each independently $C_1$ to $C_4$ hydrocarbyl, $R_4$ is $C_{10}$ to $C_{20}$ hydrocarbyl, and $R_5$ is hydrogen or $C_{10}$ to $C_{20}$ hydrocarbyl; wherein the amine phospate salt is soluble in the lubricant oil basestock at 25° C., is a liquid at 25° C., and the ratio of molar equivalents of amine to phosphate in said salt is from about 1.0 to 1.2.

2. The method of claim 1 wherein $R_1$ is $C_9$ to $C_{20}$ hydrocarbyl and $R_2$ and $R_3$ are each independently $C_1$ to $C_4$ alkyl.

3. The method of claim 2 wherein $R_2$ and $R_3$ are each methyl.

4. The method of claim 1 wherein $R_4$ is $C_{12}$ to $C_{16}$ straight chain alkyl and $R_5$ is $C_{12}$ to $C_{16}$ straight chain alkyl or hydrogen.

5. The method of claim 1 wherein the amount of amine phosphate is from 0.01 to 10 wt.%, based on lubricating oil.

6. The method of claim 1 additionally comprising at least one additive selected from the group consisting of dispersants, other antiwear agents, antioxidants, rust inhibitors, corrosion inhibitors, detergents, pour point depressants, other extreme pressure agents, viscosity index improvers, other friction modifiers and hydrolytic stabilizers.

7. The method of claim 1 wherein the lubricating oil basestock comprises a polyalphaolefin, an ester of a dicarboxylic acid and mixtures thereof.

8. The method of claim 7 wherein the polyalphaolefin is a poly(1-decene), poly(1-octene) or mixtures thereof and the dicarboxylic acid is sebacic acid.

* * * * *